United States Patent [19]

Shulman et al.

[11] Patent Number: 4,458,467

[45] Date of Patent: Jul. 10, 1984

[54] PRETENSIONER FOR STRETCHABLE FILM WEB WITH DANCER ROLLER COMPENSATION

[75] Inventors: Michael H. Shulman, Willowdale, Canada; Kenneth D. White, Grapevine; Cecil L. Hicks, Irving; William R. Watson Jr., De Soto, all of Tex.

[73] Assignee: Infra Pak (Dallas), Inc., Dallas, Tex.

[21] Appl. No.: 249,360

[22] Filed: Mar. 31, 1981

[51] Int. Cl.[3] ..... B65B 11/04; B65D 41/00; B65N 19/00

[52] U.S. Cl. ..... 53/399; 53/441; 53/556; 53/587; 242/75.4; 242/75.51

[58] Field of Search ..... 242/75.4, 55, 67.1 R, 242/67.2, 67.3 R, 75.43, 75.47, 75.51; 226/178; 53/139.3; 156/577; 53/399, 441, 556, 588, 587

[56] References Cited

U.S. PATENT DOCUMENTS

| | | | |
|---|---|---|---|
| 2,914,893 | 12/1959 | Berst | 53/556 X |
| 3,079,056 | 2/1963 | Grozhewegen | 226/178 |
| 3,539,085 | 11/1970 | Anderson et al. | 242/75.51 X |
| 3,595,495 | 7/1971 | Cloeren | 242/75.51 |
| 3,829,038 | 8/1974 | Studer | 242/75.51 X |
| 3,850,379 | 11/1974 | Stern | 242/75.4 |
| 4,012,003 | 3/1977 | Cochran | 242/55 |
| 4,166,589 | 9/1979 | Hoover | 242/55 |
| 4,302,920 | 12/1981 | Lancaster et al. | 53/399 |

FOREIGN PATENT DOCUMENTS

| | | | |
|---|---|---|---|
| 2750780 | 5/1979 | Fed. Rep. of Germany | 53/556 |
| 2281275 | 8/1974 | France | 53/182 R X |
| 52-15797 | 2/1977 | Japan | 53/556 |
| 2059906 | 4/1981 | United Kingdom | 53/556 |

*Primary Examiner*—Stuart S. Levy
*Assistant Examiner*—Lloyd D. Doigan
*Attorney, Agent, or Firm*—Kenneth R. Glaser

[57] ABSTRACT

A tensioner assembly pre-stretches a film web prior to unitizing a pallet load. The film web undergoes three stages of stretching by the tensioner assembly which includes two driven rollers and a resiliently biased dancer roller. The dancer roller engages the film and maintains it under continuous tension loading as the pallet load rotates. An electrical control signal proportional to the angular position of the dancer roller is employed by a control circuit to vary the rotational speed of the pretensioner drive rollers. The film web is stretched in a first stage between a feedstock roll and the first drive roller. A second stage of stretching occurs between the first driven roller and the second driven roller. Finally, the film web undergoes a third stage of stretching between the second driven roller and the pallet load, with the web being maintained under tension at all times by the resiliently biased dancer roller.

17 Claims, 7 Drawing Figures

PRETENSIONER FOR STRETCHABLE FILM WEB WITH DANCER ROLLER COMPENSATION

BACKGROUND OF THE INVENTION

1. Field of the Invention

The present invention relates generally to apparatus for tensioning wrapping material, and more particularly, to a pretensioner assembly for stretching a film web prior to wrapping it around a pallet load.

2. Description of the Prior Art

In the material handling art, it is common practice to load boxes or sacks of material onto a pallet for easy transportation and storage. A pallet is a tray or platform which is used in conjunction with a forklift for lifting and moving materials. Such loading arrangements in which a large number of sacks or boxes are stacked upon a wooden pallet are easily upset when moved and, therefore, must be stabilized in some manner to prevent the stack from falling over. A common method for stabilizing a palletized load is to spiral or full wrap the load with a high strength material such as stretchable plastic film or netting. This method is referred to as "unitizing".

According to conventional practice, it is known to provide a spiral wrap apparatus for palletized loads, in which a rotatable platform is situated horizontally for receiving the palletized load, and a stretchable film web is dispensed from a vertical mandrel situated adjacent the platform. According to this method, the width of the stretchable film is less than the height of the load to be wrapped, and the mandrel supporting the spool of film is located on a carriage assembly which is raised and lowered in the vertical direction while the wrapping operation is carried out. As the palletized load rotates on the platform, the spool of film is moved vertically and then downwardly, wrapping the load in a helical pattern and thereby unitizing the load.

It is also known to provide wrapping apparatus in which a single sheet of stretchable film material is wrapped about a palletized load as the load is rotated.

In the foregoing pallet wrapping methods, the stretchable film web is dispensed from a feedstock roll having at least several hundred linear feet of wrapping material. The film web is pulled from the roll by the pallet load as it rotates. The film may have wrinkles or folds which should be smoothed out prior to wrapping. It is also desirable that the film web be applied under tension so that it fits tightly around the loaded pallet. Moreover, since the cost of the film web material is a significant part of the overall handling cost, it is desirable to pre-stretch the film material as much as possible.

Several systems have been designed to supply stretchable wrapping material under tension to a pallet load. These methods include applying a brake to the mandrel on which the feedstock roll is mounted, or applying pressure to the wrapping material as it is unrolled by using a separate roller pressed against the feedstock roll. In these and other conventional methods, the wrapping material is pulled off of the feedstock roll by the rotation of the pallet load. The feedstock roll is braked so that the linear speed of the web wrapping material, as it leaves the feedstock roll, is slightly less than the linear speed of the web as it is pulled around the pallet. This provides for stretching of the wrapping material between the feedstock roll and pallet load. The stretching action pulls the wrinkles out of the web and puts it under tension so that it will fit snugly around the pallet load.

One limitation of the foregoing dispensing method is that the tension on the wrapping material is not constant. Pallet loads are usually irregular in shape and rotate in an eccentric manner due to inexact centering on a turntable. The pallet load and the roll of film interact in a manner similar to a pulley system in response to turntable rotation. The pallet load size, shape and placement on the turntable affects the velocity of the inner pulley (the roll of film). As a result, the film web is wrapped around the loaded pallet at speeds which vary throughout the wrapping operation. Since the wrapping material is pulled from the feedstock roll by the action of the rotating pallet load, these irregularities cause the tension on the wrapping material to vary. The pallet load, when wrapped in this manner, usually has tight zones and loose zones, which may cause the load to be unstable.

Because wrapping material is pulled off the feedstock roll directly by the pallet load, substantial forces are induced in the web while unrolling the wrapping material and stretching it to create tension. The pallet load may consist of relatively light objects which are easily displaced by the uneven pulling forces. In an attempt to overcome this limitation, some pallet wrapping devices include a movable member, commonly referred to as a hold-down foot, which is engagable with the top of the pallet load. The foot holds the load in place while the wrapping material is being applied. However, very light loads can still be upset by the pressure exerted by the wrapping material, and the hold-down foot may not be compatible with fragile or irregularly shaped loads.

SUMMARY OF THE INVENTION

It is, therefore, the principal object of the present invention to provide an apparatus for tensioning wrapping material before wrapping it around a loaded pallet.

It is a further object to provide a tensioner assembly for pre-stretching wrapping material and applying it to irregular or off-center loads or to relatively light loads, at high speed, and without the use of a hold-down foot.

The present invention provides a multiple stage pretensioner drive roller assembly positioned so that the wrapping material passes around first and second drive rollers after it plays out from a feedstock roll and before it is wrapped around the pallet load. Each drive roller is driven by a variable speed electric motor, the speed of each motor being controlled by a control circuit. The rotational speed of the feedstock roll is limited by a variable brake. The brake automatically adjusts to maintain a predetermined level of drag or braking force on the feedstock roll. A resiliently biased dancer roller applies yieldable, thrusting force against the film web section between the drive roller assembly and the pallet load so that the film web is maintained under tension loading at all times.

An electromechanical position transducer coupled to the dancer roller develops an analog signal which is proportional to the angular position of the dancer roller. The analog position signal forms an input to the control circuit which increases the speed of both drive motors when the position of the dancer roller moves against its resilient bias, corresponding with an increase in web draw, and decreases the speed of both drive motors when the dancer roller moves in a direction to relieve its bias, corresponding with a decrease in web draw, thereby maintaining a substantially constant tension in the film web between the drive roller assembly and the pallet load, while playing out the film web in response to demand.

The practical result of the foregoing arrangement is that instantaneous adjustments are made to accomodate web composition variation, and excessive stretching around protruding cartons or objects on the pallet. Thus, in effect, an irregular load is theoretically "centered" on the pallet, and the web is played out and applied as if a perfect cylinder were sitting in the center point of the turntable.

It is typical that the film web material can be stretched, without breaking, up to three to four times its unstretched length. If the wrapping material is stretched near or beyond its elastic limit, it is readily apparent that less film need be used to wrap a given pallet load than when unstretched or only slightly stretched wrapping material is used.

It is, therefore, a further object of the present invention to minimize the amount of wrapping material needed to wrap a given pallet load. This is accomplished in the preferred embodiment by adjusting the speed of each drive roller relative to the feedstock roll, and relative to each other, so that the wrapping material undergoes stretching in two stages. Thus, a significant cost savings in wrapping material is comprehended by the present invention.

For some applications, rotational speed of the drive roller assembly is further maintained less than the rotational speed of the pallet load turntable so that the web undergoes a third stage of stretching as it is pulled from the pretensioner drive roller assembly by the rotating pallet load.

It is another object of the present invention to enable the wrapping material to be fully stretched to the point that it loses it memory. Under normal circumstances, film which has not been fully stretched will stretch further upon the application of an additional force, and this additional stretching may occur, for example, due to a shift of the load. This result is undesirable since the load is not then held firmly in place. In the present invention, the dual drive roller assembly is controllable to ensure that the wrapping material is fully stretched before it is applied to the pallet load. The ability of the control mechanism of the invention to sense the speed fluctuation due to irregular or off-center pallets, and the ability to compensate for such variations, furthermore enables the web to be fully elongated as it is wrapped without being stretched to the breaking point.

It is yet another object of the invention to provide a tensioner assembly which is compatible with film having damaged edges. The drive roller assembly and feedstock roll are controlled so that the wrapping material is stretched, but not so far as to cause tearing of the damaged edges. The adjustable tension feature of the present invention also allows lower grade film to be used when wrapping pallets. Again, the drive roller is controlled so that the proper amount of tension is applied for each type of wrapping material used.

It is yet another object of the present invention to eliminate the need for a hold-down foot pressing down on the top of the load for light-weight pallet loads. In the present arrangement, virtually all stetching takes place between the feedstock roll and the output of the pretensioner (or prestretching) drive roller assembly. A minimum of force is applied to the pallet load by the wrapping material during the third stage of stretching (between roller assembly and load). For certain light weight pallet loads, substantially all of the stretching is accomplished by the dual drive roller assembly, with virtually no stretch loading occurring between the drive roller assembly and the pallet load. For this operation, the rotational speed of the pallet turntable is synchronized with the speed of the second drive roller so that the draw rate of the pallet load is equal to the delivery rate of the second drive roller.

In a preferred embodiment, the dancer roller assembly comprises parallel dancer roller mounted on a movable frame, with the wrapping material passing around the first dancer roller, and then around the second dancer roller. The mechanical advantage of the extra loop of wrapping material around the second dancer roller provides for additional take-up capability for accommodating unusual or irregular pallet loads.

The novel features which characterize the present invention are defined by the appended claims. The foregoing and additional objects and advantages of the present invention will hereinafter appear and for purposes of illustration, but not of limitation, a preferred embodiment is shown in the drawings.

DETAILED DESCRIPTION OF THE PREFERRED EMBODIMENT

Figure 1:
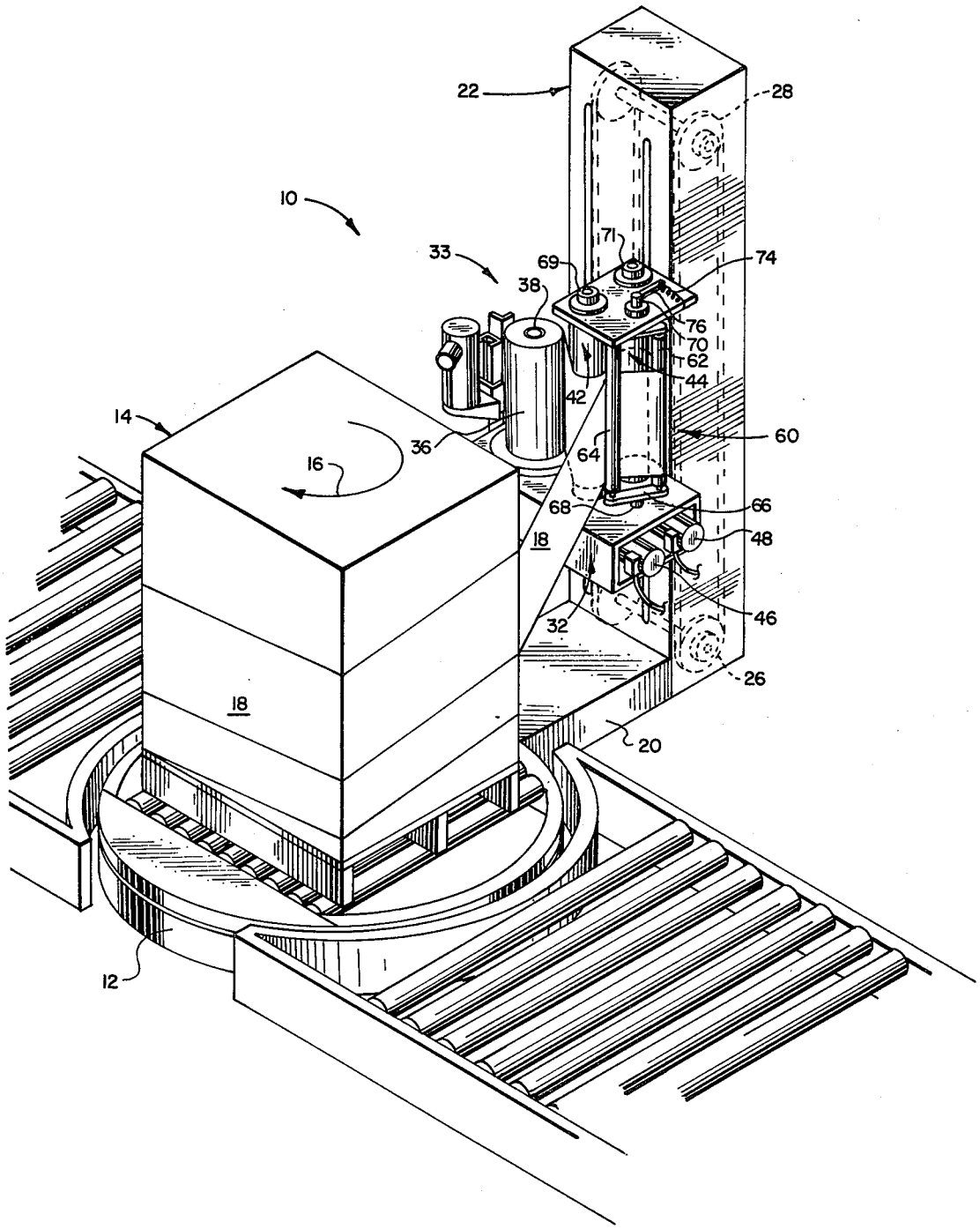
FIG. 1 is a perspective view of an automatic wrapping station having a web pretensioner assembly.

In the description which follows, like parts are marked throughout the specification and drawing with the same reference numerals, respectively. The drawings are not necessarily to scale and in some instances, portions have been exaggerated in order to more clearly depict certain features of the invention.

The invention will now be described in combination with an automated wrapping station wherein a stretchable film web is wrapped in a helical pattern around a vertical pallet load. It should be understood, however, that the principles of the invention are applicable to other film web dispensing operations, including vertical, horizontal, upside down or overhead counter-rotating dispensing operations, in which a web of wrapping material is applied in a helical wrapping pattern or a full web is applied in multiple convolutions. Moreover, the principles of the invention are applicable to other loads, including loads which are supported horizontally rather than vertically. It should further be understood that the invention may be used to good advantage for applying tension to various wrapping materials, including wrapping materials which resist stretching such as netting, paper, metallic sheeting and nonresilient polymer webs.

Figure 2:
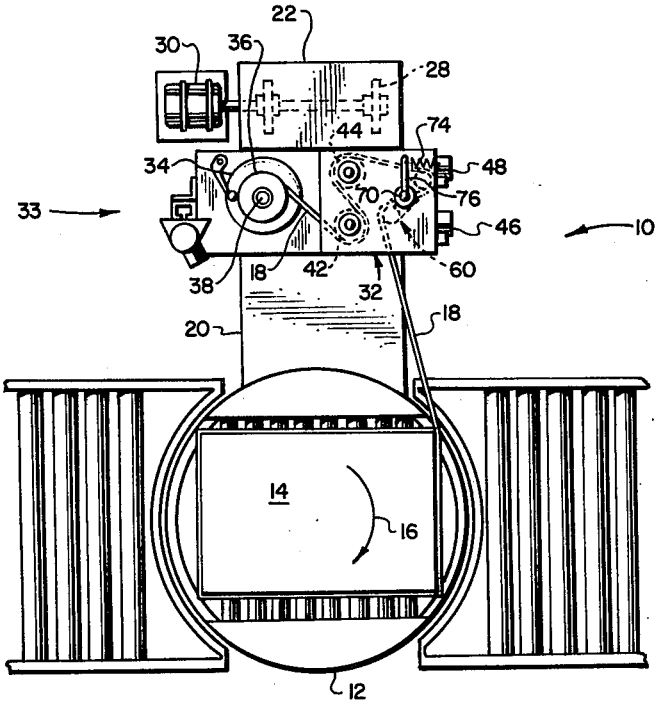
FIG. 2 is a plan view of the automatic wrapping station and pretensioner assembly.

Referring to FIGS. 1 and 2, an automatic wrapping station for pretensioning and applying elastic wrapping material to a pallet load is designated generally by the reference numeral 10. A turntable 12 supports a palletized load 14. The turntable 12 is of a type conventional in the art, and the associated mechanisms for driving the turntable 12 and handling the palletized load 14 are not shown. In operation, the turntable 12 rotates in a clockwise direction as indicated by the arrow 16.

The palletized load 14 is wrapped in a helical pattern by at least one layer of wrapping material 18. The wrapping material 18 is preferably a stretchable plastic film web of a type commonly used in wrapping palletized loads.

A base 20 is mounted on the floor adjacent the turntable 12. A support tower 22 is coupled to the base 20, and extends vertically therefrom. Inside the tower 22, an endless drive chain 24 is engaged by a lower sprocket 26 and an upper sprocket 28. A reversible electric motor 30 is coupled in driving engagement with the lower sprocket 26.

An elevator carriage block 32 is coupled to the drive chain 24, and is slidably mounted on the outside of the support tower 22. The elevator block 32 is driven up and down the support tower by the electric motor 30.

Figure 5:
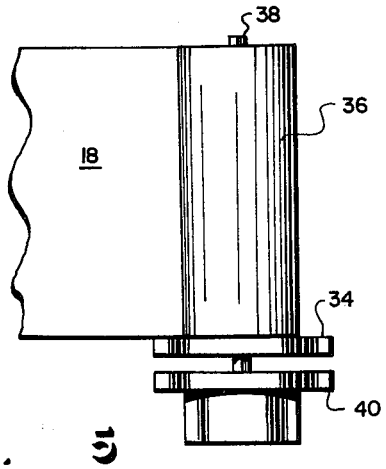
FIG. 5 is an elevation view of a feedstock roll and brake assembly.

Mounted on top of the elevator block 32 is a web dispenser and pretensioner assembly 33. The web dispenser and pretensioner assembly includes a mandrel 34 (FIG. 2) rotatably mounted on the upper surface of the elevator block 32. A feedstock roll 36 is received on the mandrel around the mandrel shaft 38. The feedstock roll 36 is rigidly secured to the mandrel 34 by a core lock (not shown) carried by the mandrel shaft 38. The mandrel 34 utilizes a conventional variable resistance brake 40 (FIG. 5) to maintain a predetermined drag on the feedstock roll 36. The drag level is preset according to the type of film, the rpm of the turntable, and the percent stretch desired. The applied braking force is automatically increased and decreased to maintain the desired drag level. Alternatively, a constant resistance braking mechanism assouated with the feedstock roll or the film being fed may be used.

After leaving the feedstock roll 36, the film web 18 is engaged by a first drive roller 42 and thereafter around a second drive roller 44. The routing of the web 18 around the first and second drive rollers can best be seen in FIG. 6. Each drive roller 42, 44 is covered with a non-slip material such as rubber which provides good frictional engagement with the web material 18.

The drive rollers 42, 44 are driven by variable speed electric motors 46, 48, respectively.

The variable brake 40 is preset to apply a desired level of drag against rotation of the feedstock roller 36. Thereafter, the brake 40 automatically increases and decreases the applied braking force to maintain the desired drag level. The brake 40 maintains a substantially constant tension in the section of the web between the feedstock roll 36 and the first drive roller 42, whereby the web undergoes a first stage of stretching as it is pulled off of the feedstock roll. The second drive roller 44 is driven by electric drive motor 48 at a rotational speed which exceeds the rotational speed of the first drive roller, so that the film web 18 undergoes a second stage of stretching between the first drive roller 42 and the second drive roller 44.

After leaving the second drive roller 44, the film web 18 is applied indirectly to the palletized load 14 by way of a dancer roller assembly 60 as subsequently described. The web 18 is then wrapped in a helical path around the load. Preferably, the delivery rate of the second drive roller 44 is slightly less than the takeup rate of the palletized load so that the film web 18 undergoes a third stage of stretching between the second drive roller 44 and the pallet load.

Figure 3:
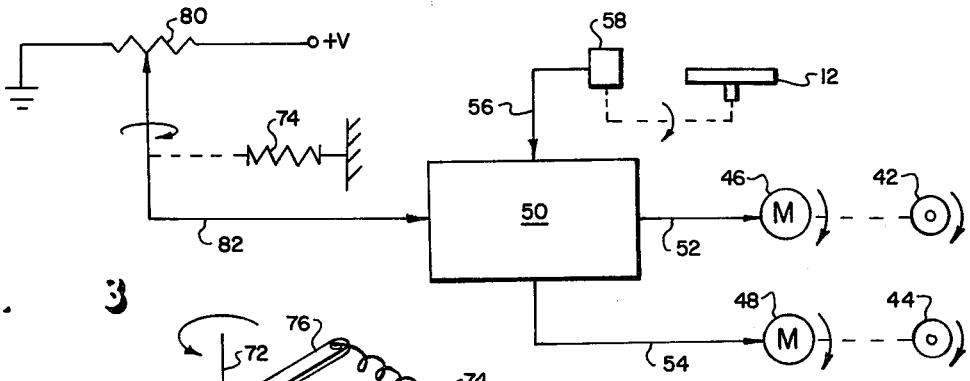
FIG. 3 is a block diagram of a control system for the pretensioner assembly.

Referring now to FIG. 3, coordination of the drive motor speed with respect to the turntable speed is provided by a control circuit 50 which generates motor drive signals 52, 54 in response to an analog signal 56. The rotational speed of the turntable 12 is sensed by a detector 58, for example, a tachometer generator, which develops the analog signal 56 in proportion to the rotational speed of the turntable. The control circuit 50 is responsive to the analog signal 56 to limit the upper range of rotational speed of the drive motors 46, 48 whereby the rotational speed of the second drive roller 44 is maintained slightly less than the rotational speed of the turntable 12. In response to the differential rotation, the web 18 undergoes a third stage of stretching as it is pulled by the rotating pallet load.

In response to the tension applied by the drive rollers and by the pull of the pallet load, the web 18 undergoes first, second and third stages of stretching. Preferably, the web is stretched to near its elastic limit in the first two stages of stretching with substantially complete elongation being obtained during the third stage of stretching as the web is pulled from the second drive roller 44 by rotation of the palletized load 14.

Most of the stretching of the film web 18 occurs in the first and second stages, with the result that there is a relatively small pulling force applied by the pallet load to the film 18 in the third stage as it is pulled in response to rotation of the turntable. This pulling force can be decreased to as low a level as desired by adjusting the delivery rate of the second drive motor 44 to approach or equal the take-up rate of the pallet load. Therefore, palletized loads which are relatively light or easily displaced from the pallet are not adversely affected by the pulling force applied to the film web 18. This reduces the need for a hold-down foot for light pallet loads.

In operation, the film web 18 is wrapped around the palletized load 14 in a helical pattern as the turntable 12 is rotated and the pretensioner assembly is simultaneously moved up and down by action of the electric drive motor 30. Because of the stretching effect produced by the drive rollers, the film web 18 is wrapped around the palletized load after undergoing elongation.

However, the film web 18 will be subject to uneven pulling forces which arise in response to the pulling action of an irregular pallet load. Because the film web is pulled off the drive roller 44 by the rotating pallet load, substantial forces are induced in the web 18 while it is being wrapped. Most loads are rectangular in shape, or assume some other uneven form. These irregularities cause the tension induced in the film web material to vary. The pallet load, when wrapped in this manner, usually has tight zones and loose zones, which may lead to an unstable pallet load. The uneven pulling force is accommodated by a dancer roller assembly 60 (FIG. 4) which is disposed in the web delivery path between the second drive roller 44 and the pallet load.

Figure 4:
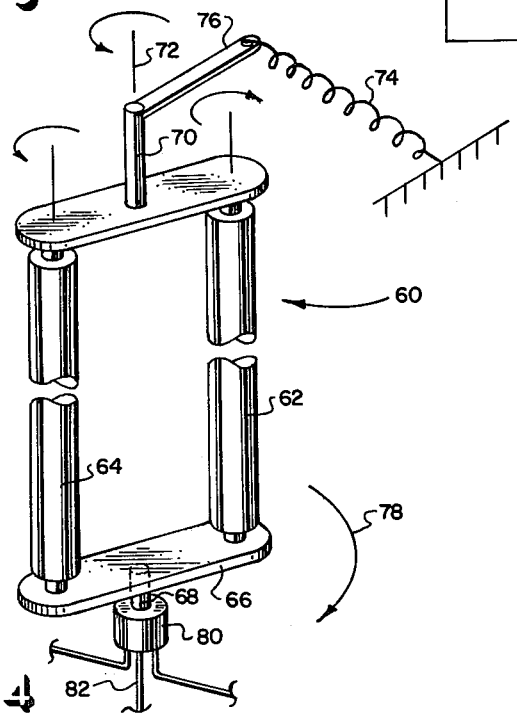
FIG. 4 is a perspective view of the dancer roller assembly.
Figure 6:
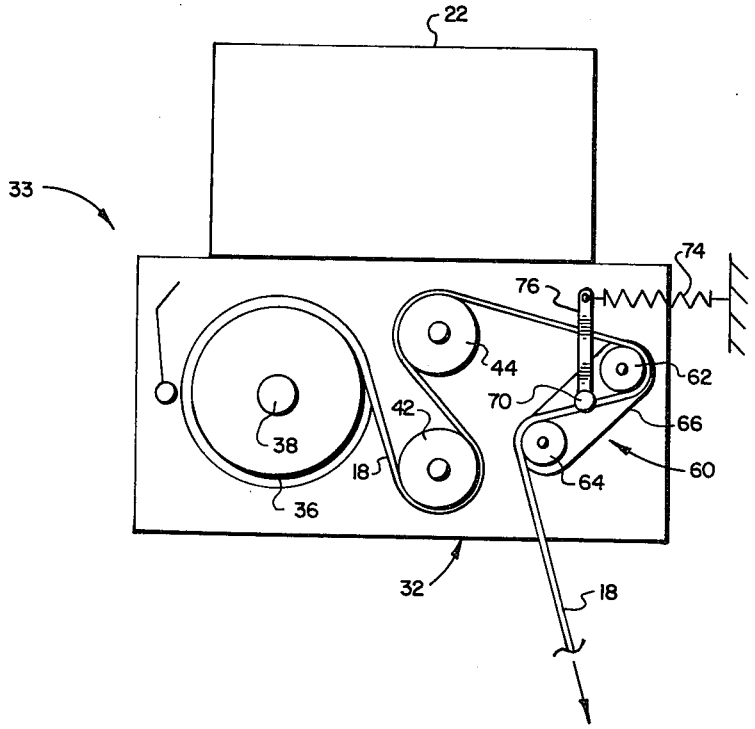
FIG. 6 is a preferred web threading diagram for the pretensioner assembly of the invention; and, FIG. 7 is a schematic diagram of a preferred drive motor control circuit.

Referring now to FIGS. 4 and 6, the dancer roller assembly 60 includes at least one, and preferably two dancer rollers 62, 64 which aare mounted for free rotation on a support frame 66. The support frame 66 is mounted on lower and upper pivot shafts 68, 70, respectively, which are journalled in bearings 69, 71 (FIG. 1) for free rotation about a vertical axis 72. The dancer roller assembly 60 is biased for clockwise rotation about the vertical axis 72 by a tension spring 74 which is connected between the elevator frame and a turn arm 76.

Other resilient tensioning devices such as a leaf spring or a pneumatic cylinder may be substituted for the tension spring 74.

As can best be seen in FIGS. 2 and 6, the film web 18, after it leaves the second drive roller 44, is threaded around the first dancer roller 62, through the intervening space between the two rollers and then around the second dancer roller 64. According to this arrangement, the pulling force exerted by the rotating pallet load 14 is applied against the bias force developed by the tension spring 74. The result of this combination is that the dancer roller assembly 60 tends to rotate in the clockwise direction as indicated by the arrow 78 (FIG. 4) in response to a decrease in the rate at which the film web is being drawn by the pallet load, but tends to move in the counterclockwise direction in response to an increase in the pulling force exerted by the pallet load.

An electromechanical position transducer 80 is coupled to the lower pivot shaft 68 and develops an analog signal 82 which is proportional to the angular position of the dancer roller assembly. The transducer 80 is preferably a variable resistor. Referring to FIG. 3, the analog position signal 82 forms an input to the control circuit 50. Control circuit 50 increases the speed of both drive motors when the position of the dancer roller 60 moves in opposition to the spring bias, corresponding to an increase in web draw, and decreases the speed of both drive motors 46 and 48 when the dancer roller assembly is pulled by the spring 74 in a clockwise direction, corresponding to a decrease in web draw. As a specific feature, when the dancer roller assembly rotates toward its fully clockwise position, a limit switch is engaged for inactivating both drive motors. By this arrangement, a substantially constant tension is maintained in the film web 18 between the second drive roller and the pallet load, while the film is played out in response to irregular demand; and the film feed is interrupted in response to film breakage or the end of the wrapping cycle, for example (i.e. lack of demand).

Figure 7:
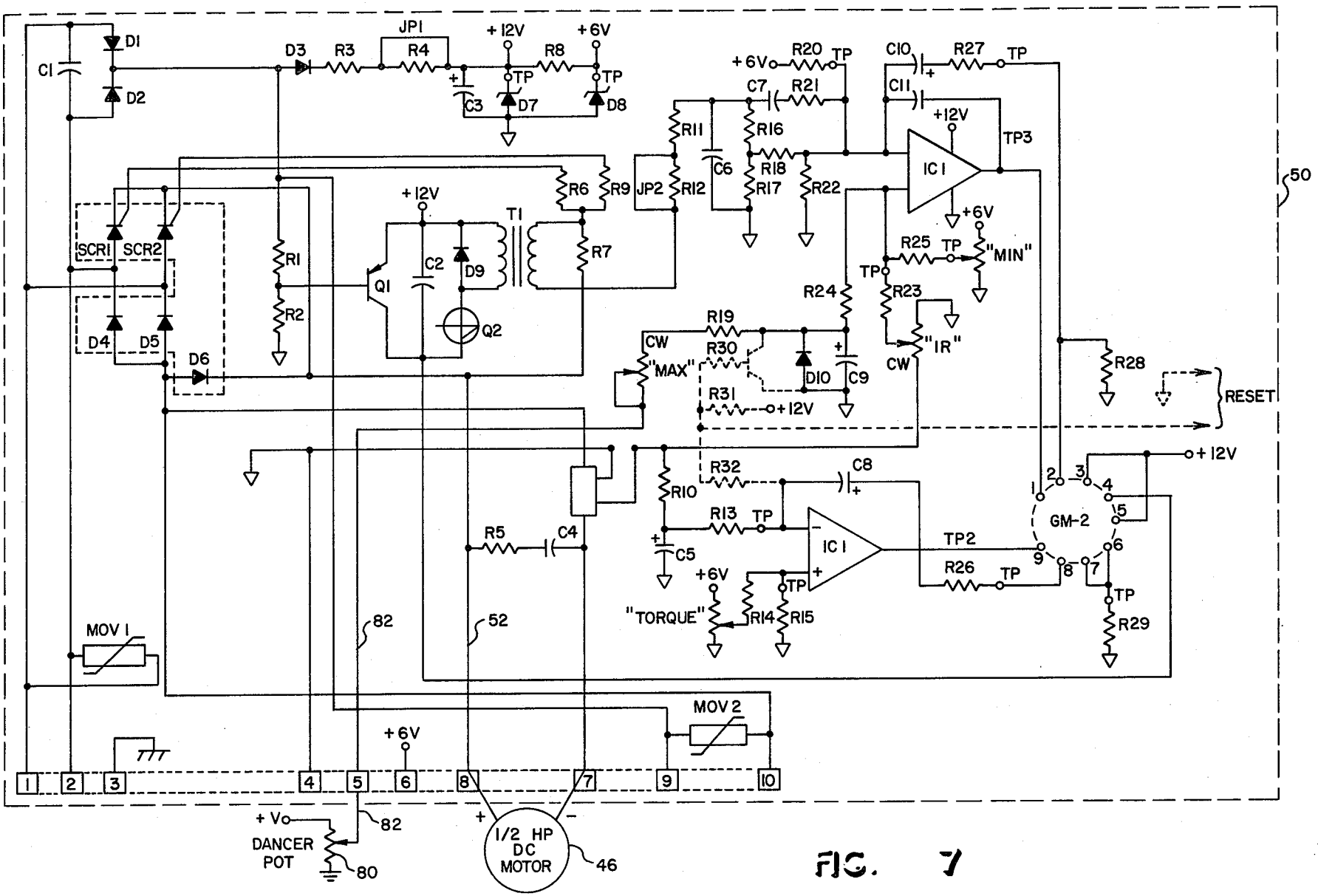

The control circuit 50 can be any conventional DC drive control circuit which is commonly available. For example, see U.S. Pat. No. 4,121,141 entitled "D.C. Motor Speed Control Circuitry". However, the preferred control circuit incorporates silicon control rectifier elements as illustrated in FIG. 7. Each drive motor is independently controllable for operation at different speeds and is separately coupled to a drive motor control circuit 50 as indicated in FIG. 7. In that arrangement, the dancer roller feedback signal 82 is shared by both of the drive motor circuits, whereby both drive motors 46, 48 are simultaneously responsive to changes in the dancer roller position.

According to the foregoing arrangement, with dancer roller compensation, instantaneous adjustments are made to accommodate irregularities such as web composition variation, and excessive stretching around protruding cartons or other irregular loads. Thus, in effect, an irregular load is theoretically "centered" on the pallet, with the film web being played out and applied as if a perfect cylinder was sitting in the center point of the turntable 12.

Although a preferred embodiment of the invention has been described in detail, it should be understood that various changes, substitutions and alterations can be made therein without departing from the spirit and scope of the invention as defined by the appended claims.

What is claimed is:

1. In an automated wrapping station for dispensing a web of wrapping material from a feedstock roll positioned on a mandrel shaft to a non-symmetric load supported on a turntable in which a brake assembly is coupled to the mandrel shaft for limiting the rate at which the web is played out from the feedstock roll, the improvement comprising:

a first drive roller disposed in the path of advancement of the web for engaging and pulling the web from the feedstock roll, and for initially prestretching the web between the feedstock roll and the first drive roller;

a second drive roller disposed in the path of advancement of the web for engaging and pulling the web from the first drive roller, and for prestretching the web a second time between the first drive roller and the second drive roller;

a variable speed drive means coupled to said first and second drive rollers for driving said first and second drive rollers;

a control circuit coupled to the variable speed drive means for controlling the speed of the drive means, and the speeds of the first drive roller and the second drive roller.

2. The improvement as defined in claim 1, including a sensor coupled to the turntable for generating an analog signal proportional to the rotational speed of the turntable;

said control circuit being coupled to said turntable sensor for limiting the speed of the variable speed drive means in response to the turntable analog signal.

3. The improvement as defined in claim 1, including:

a dancer roller assembly movably mounted for transverse displacement relative to the direction of web movement; and resilient means biasing said dancer roller for thrusting engagement against the stretchable film web.

4. The improvement as defined in claim 3, said resilient bias means comprising:

a tension spring connected to said dancer roller assembly for yieldably resisting transverse displacement of said dancer roller assembly.

5. The improvement as defined in claim 3, said dancer roller assembly comprising:

a support frame mounted for rotation about a vertical axis; and, first and second dancer rollers mounted on said support frame for rotation in parallel with the rotational axis of the support frame.

6. The improvement as defined in claim 3, including a sensor coupled to said dancer roller assembly for generating an analog signal proportional to displacement of the dancer roller assembly;

said control circuit being coupled to said dancer roller displacement sensor for varying the speed of the variable speed drive means in response to the dancer roller analog signal.

7. A method for dispensing a web of wrapping material from a feedstock roll mounted on a mandrel shaft to a palletized load comprising the steps of:

coupling a braking force to the mandrel shaft to limit the rate at which the web is played out;

engaging the web with a first rotating drive roller and pulling it from the feedstock roll against the drag of the brake;

initially stretching the web between the first rotating drive roller and the feedstock roll;

engaging the web with a second rotating drive roller and pulling it from the first rotating drive roller;

secondarily stretching the web between the first rotating drive roller and the second rotating drive roller;

applying a yieldable, thrusting force against the web by a resiliently biased, movable dancer roller; and, pulling the web against the bias force of the dancer roller and away from the second rotating drive roller by rotation of the palletized load to effect a tertiary stretching of the web between the second drive roller and the palletized load.

8. The method as defined in claim 7, including the steps:

sensing the position of the dancer roller; and, varying the speed of the rotating drive rollers in response to the position of the dancer roller.

9. The method as defined in claim 7, including the step:

engaging the web with a second rotating drive roller and pulling it from the first rotating drive roller at a rate which is faster than the rate at which the web is pulled by the first drive roller.

10. Web dispensing and pretensioning apparatus comprising, in combination:

a rotatable mandrel for carrying a feedstock roll of web material to be pretensioned;

variable braking means coupled to said mandrel for automatically maintaining a predetermined level of drag on said mandrel;

drive roller means disposed in the path of advancement of the web for pulling the web from the feedstock roll, said drive roller means comprising a first drive roller disposed in the path of advancement of the web for pulling the web from the feedstock roll and for effecting an initial stretching of the web between the feedstock roll and the first drive roller, and a second drive roller disposed in the path of advancement of the web for pulling the web from the first drive roller and for effecting a second stretching of the web between the first drive roller and the second drive roller;

variable speed drive means coupled to said first and second drive rollers for driving said first and second drive rollers;

a dancer roller assembly movably mounted for transverse displacement relative to the direction of web movement; and resilient means biasing said dancer roller assembly for yieldable, thrusting engagement against the web.

11. Web dispensing and pretensioning apparatus comprising, in combination:

a rotatable mandrel for carrying a feedstock roll of web material to be pretensioned;

variable braking means coupled to said mandrel for automatically maintaining a predetermined level of drag on said mandrel;

a first drive roller disposed in the path of advancement of the web for pulling the web from the feedstock roll, and for effecting an initial prestretching of the web between the feedstock roll and the first drive roller;

a second drive roller disposed in the path of advancement of the web for pulling the web from the first drive roller, and for effecting a second prestretching of the web between the first drive roller and the second drive roller;

a dancer roller assembly movably mounted for transverse displacement relative to the direction of web movement;

resilient means biasing said dancer roller assembly for yieldable, thrusting engagement against the web;

a sensor coupled to said dancer roller assembly for generating an analog signal proportional to the position of the dancer roller assembly; and control means coupled to said first and second drive rollers and to said sensor for independently varying the drive speeds of said first and second drive rollers in response to the said analog dancer roller signal.

12. In an apparatus for dispensing a web of material from a feedstock roll in which a brake assembly is coupled to the feedstock roll for limiting the rate at which the web is played out from the feedstock roll, the improvement comprising:

a first drive roller disposed in the path of advancement of the web for engaging and pulling the web from the feedstock roll, and for effecting an initial prestretching of the web between the feedstock roll and the first drive roller;

a second drive roller disposed in the path of advancement of the web for engaging and pulling the web from the first drive roller, and for effecting a second prestretching of the web between said first drive roller and said second drive roller;

a dancer roller mounted for transverse movement relative to the direction of web movement, said dancer roller being biased for yieldable, thrusting engagement against the web;

a variable speed drive motor coupled to said first and second drive rollers for increasing and decreasing drive roller speed;

a sensor coupled to said dancer roller for generating an analog signal proportional to the position of the dancer roller; and a control circuit coupled to said variable speed drive motor and to said sensor for varying the speed of the drive motor in response to the dancer roller analog signal.

13. Automated wrapping apparatus for dispensing a web of stretchable wrapping material from a feedstock roll to a load to be wrapped by said web, comprising:

first roller means disposed between said feedstock roll and said load for initially prestretching said web of material between said feedstock roll and said first roller means prior to its being wrapped on said load;

second roller means spaced from said first roller means in the direction and the path of advancement of said web between said first roller means and said load for secondarily stretching said web of material between said first roller means and said second roller means;

power means for rotatably driving said first and second roller means so that the rotational speed of said second roller means exceeds the rotational speed of said first roller means; and control means for said power means for varying the rotational speed at which said first and second roller means are driven in response to variations of tension in said web.

14. The apparatus as defined by claim 13 whereby said control means comprises a dancer roller assembly disposed between said second roller means and said load and mounted for transverse movement relative to the direction of web movement, said dancer roller being biased for yieldable, thrusting engagement against said web.

15. Stretch wrapping apparatus, comprising:

a rotatable turntable for supporting a load to be wrapped by a web of stretchable material;

a carriage adapted for vertical movement with respect to said load, said carriage supporting a feedstock roll of said stretchable material, whereby said web of material is pulled from said feedstock roll to wrap said load in response to the rotation of said turntable;

first roller means disposed between said feedstock roll and said turntable in the path of advancement of said web for stretching said web of material between said feedstock roll and said load prior to its being wrapped on said load;

second roller means disposed between said first roller means and said load for secondarily prestretching said web of material between said first roller and said load prior to its being wrapped on said load;

variable speed drive means for driving said first and second roller means so that the rotational speed of said second roller means exceeds the rotational speed of said first roller means; and control means operatively coupled to said variable speed drive means for varying the rotational speeds of said first and second roller means in response to variations of tension in said web.

16. The apparatus as defined by claim 15 whereby said control means comprises a dancer roller assembly mounted for transverse movement relative to the direction of web movement, said dancer roller being biased for yieldable, thrusting engagement against said web.

17. Stretch wrapping apparatus, comprising:

a feedstock roll of a web of stretchable wrapping material;

a load to be wrapped by said web of stretchable wrapping material;

first roller means disposed between said feedstock roll and said load for initially prestretching said web of material between said feedstock roll and said first roller means prior to its being wrapped on said load;

second roller means spaced from said first roller means in the direction and the path of advancement of said web between said first roller means and said load for secondarily stretching said web of material between said first roller means and said second roller means;

power means for rotatably driving said first and second roller means so that the rotational speed of said second roller means exceeds the rotational speed of said first roller means; and control means for said power means for varying the rotational speed at which said first and second roller means are driven in response to variations of tension in said web.

* * * * *